US005135107A

United States Patent [19]

Ingraham

[11] Patent Number: 5,135,107

[45] Date of Patent: Aug. 4, 1992

[54] GOLF BAG WITH GOLF CLUB SEPARATORS

[76] Inventor: Clifford R. Ingraham, 937 Teal Dr., Fort Collins, Colo. 80521

[21] Appl. No.: 806,017

[22] Filed: Dec. 9, 1991

[51] Int. Cl.[5] ..... A63B 55/00

[52] U.S. Cl. ..... 206/315.6; 206/315.2; 211/70.2

[58] Field of Search ..... 206/315.2–315.8; 211/70.2; 248/96

[56] References Cited

U.S. PATENT DOCUMENTS

| | | | |
|---|---|---|---|
| 2,128,546 | 8/1938 | Venmore | 211/70.2 |
| 2,938,559 | 5/1960 | Harkrader | 206/315.2 |
| 3,053,298 | 9/1962 | Stamp | 206/315.6 X |
| 3,101,108 | 8/1963 | Ingoldt | 206/315.6 |
| 3,967,667 | 7/1976 | Robinson | 206/315.6 |
| 3,980,115 | 9/1976 | Longo | 206/315.6 |
| 4,055,207 | 10/1977 | Goodwin | 206/315.6 |
| 4,200,131 | 4/1980 | Chitwood et al. | 206/315.6 |
| 4,304,102 | 7/1981 | Isabel | 206/315.6 |
| 4,304,278 | 12/1981 | Ruhlandt | 211/70.2 X |
| 4,332,283 | 1/1982 | Rader | 206/315.6 |
| 4,383,563 | 5/1983 | Kirchhoff, Jr. | 206/315.2 |
| 4,629,202 | 12/1986 | Nelson et al. | 206/315.2 X |
| 4,746,014 | 5/1988 | Very | 206/315.6 |
| 4,750,617 | 6/1988 | Anderson et al. | 206/315.2 X |
| 4,838,416 | 6/1989 | Carman | 206/315.2 |
| 4,944,396 | 7/1990 | Larkin | 206/315.6 |
| 5,050,884 | 9/1991 | Flory | 206/315.2 |

OTHER PUBLICATIONS

Austad's, Christmas, 1991, catalog; pp. 16–19 Dec. 1991.

Las Vegas Discount Gold and Tennis, Fall/Christmas, 1991, catalog; pp. 24–26 Dec. 19, 1991.

*Primary Examiner*—Sue A. Weaver
*Attorney, Agent, or Firm*—William E. Hein

[57] ABSTRACT

A golf bag contains a plurality of parallel vertical tubes fixedly arranged therein, each of which accommodates the shaft of one of the clubs comprising the set of clubs to be retained in the bag. A tube header retains the top ends of a number of the tubes at one height and the remainder of the tubes at another height. The tubes and header are arranged such that a number of the tubes are centered euqidistantly on a circle within the outer periphery of the tube header, with the remaining tubes positioned inside that circle. Each of the tubes designated for receiving a particular iron club includes an outward facing notch therein that extends downward into an adjacent portion of the tube header to retain the heads of the respective iron clubs in an outwardly directed, fixed position. Each of the notches is shaped in correspondence with the shape of the head of the specific iron club which it is intended to receive. Four of the tubes, centered on a diametric line across the tube header at the highest level thereof, are designated to receive the four wood clubs of a set. Each of these four tubes has a plug at a different position near the bottom of the tube to receive the shaft end of a wood club such that when those clubs are inserted into their respective tubes their heads are at different heights and above the heights of the iron clubs to thereby prevent interference with each other as well as interference with the heads of the iron clubs.

4 Claims, 2 Drawing Sheets

GOLF BAG WITH GOLF CLUB SEPARATORS

BACKGROUND AND SUMMARY OF THE INVENTION

This invention relates generally to golf bags and more specifically to a golf bag in which the clubs are arranged for ease of selection and to prevent interference between adjacent clubs. Most prior art golf bags are of a simple design in which a number of golf clubs comprising a set are randomly positioned with the shaft end of each club resting on the bottom of the bag. These bags are disadvantageous in that the heads of the clubs are free to rotate into contact with each other, oftentimes resulting in damage to the heads. In addition, the shafts of the clubs are prone to entanglement that causes difficulties in removing or inserting a particular club, to say nothing of the marring caused to the shafts of expensive clubs that have graphite shafts. Moreover, in this type of bag, the clubs are at best randomly positioned in the bag, with the position of the clubs constantly changing as the bag is transported or as individual clubs are removed or inserted.

Various attempts at solving the problems described above have been made in the prior art. For example, head covers made of soft cloth or fur materials are available to prevent damage to the heads of clubs. However, these covers are a nuisance to remove from a club selected for play or to replace on a club being returned to the bag. In some known types of golf bags, vertical compartments have been fashioned in an attempt to prevent tangling of the club shafts. However, each of these compartments typically retains three or more clubs, which are free to move around in their compartment and cause damage to each other. Removable plastic tubes are available in the prior art for insertion into a golf bag for the purpose of individually receiving the club shafts and keeping them separated from each other. In another known type of golf bag, fixed plastic tubes are provided for receiving the club shafts in a separated position.

None of the above-described prior art golf bags prevent free rotation of the heads of the clubs that are retained therein, a condition that interferes with their accessibility to the user and, as previously stated, is likely to result in damage to the heads. A so-called Eagle's Nest bag attempts to address this problem by providing a vertically sloping rack at the top of the bag, in which the heads of iron clubs are individually retained in fixed positions. However, this prior art bag makes no provision for wood clubs and provides no protection for the shafts of individual clubs to prevent contact that results in marring the shafts and entanglement thereof.

It is therefore the principal object of the present invention to provide an improved golf bag in which the shafts of a set of golf clubs are individually retained to prevent interference between them, in which the heads of iron clubs are retained in predetermined fixed positions of ready accessibility to the user, and in which the heads of wood clubs are arranged at different heights above the heads of the iron clubs to make them readily identifiable and accessible and to prevent interference with the heads of other wood or iron clubs.

This and other incidental objects are accomplished in accordance with the illustrated preferred embodiment of the present invention by providing a generally cylindrical bag having a plurality of vertical tubes fixedly arranged therein, the number of which corresponds to the number of clubs comprising the set of clubs to be retained in the bag. The tubes are retained within the bag in parallel relationship to each other by means of a circular tube header positioned at the top of the bag and a tube separation plate positioned intermediate the length of the tubes. The tube header retains the top ends of a plurality of the tubes at one height and the top ends of a remaining plurality of the tubes at another height. The tubes and header are arranged such that a number of the tubes are centered on a circle within the outer periphery of the tube header, with the remaining tubes positioned inside that circle. Each of the tubes designated for receiving a particular iron club includes an outward facing notch therein that extends downward into an an adjacent portion of the tube header to retain the heads of the respective iron clubs in an outwardly directed, fixed position Each of the notches is shaped in correspondence with the shape of the head of the specific iron club which it is intended to receive. Four of the tubes, centered on a diametric line across the tube header at the highest level thereof, are designated to receive the four wood clubs of a set. Each of these four tubes has a plug near the bottom of the tube to receive the shaft end of a club such that when the wood clubs are inserted into these tubes their heads are at different heights above the heights of the iron clubs to thereby prevent interference with each other as well as interference with the heads of the iron clubs.

DETAILED DESCRIPTION OF THE PREFERRED EMBODIMENT

Figure 1:
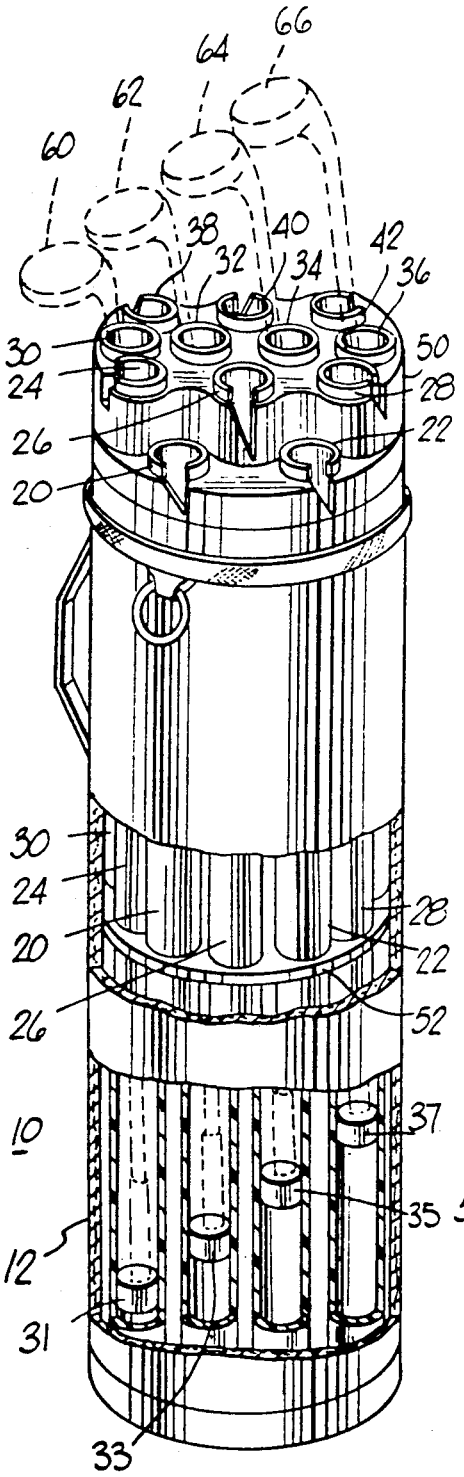
FIG. 1 is a pictorial illustration of a golf bag constructed in accordance with the present invention.
Figure 2:
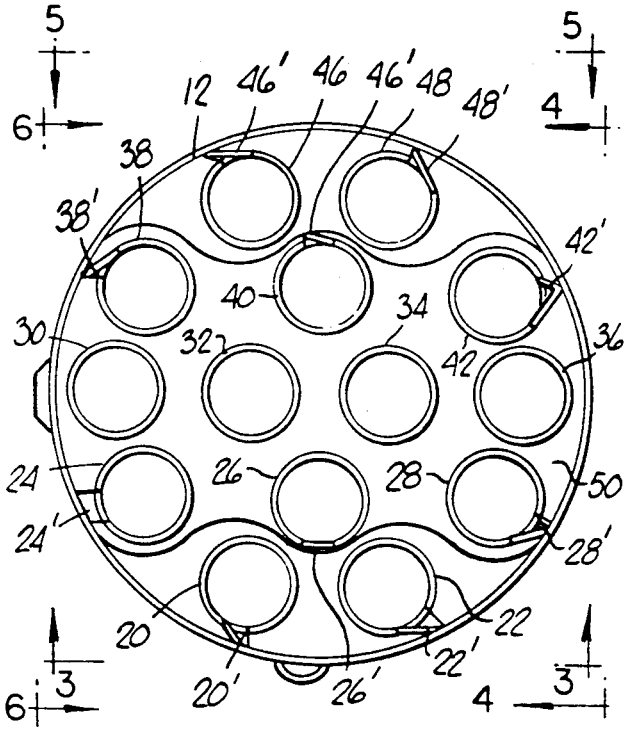
FIG. 2 is a top view of the golf bag of FIG. 1.
Figure 3:
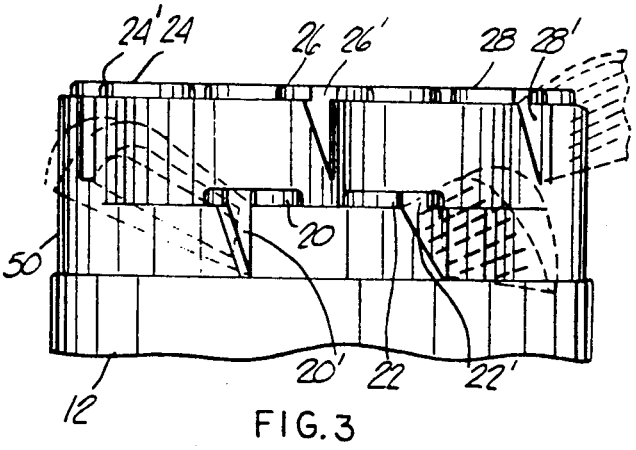
FIG. 3 is a side view of the top portion of the golf bag of FIG. 1 taken along the line 3—3 of FIG. 2.
Figure 4:
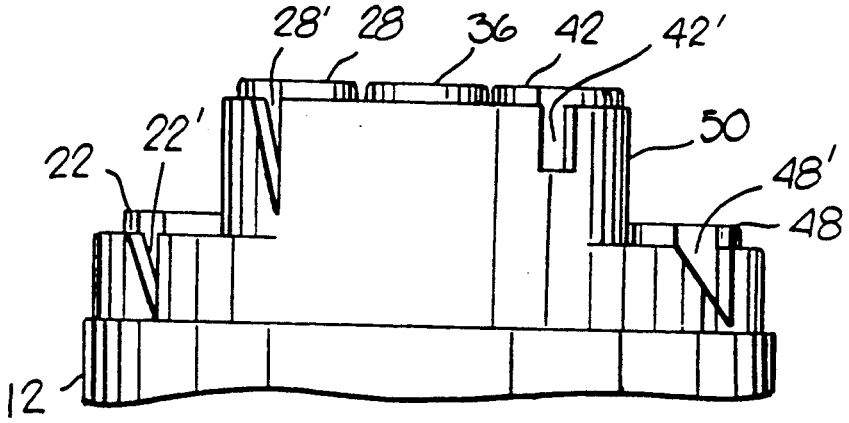
FIG. 4 is a side view of the top portion of the golf bag of FIG. 1 taken along the line 4—4 of FIG. 2.
Figure 5:
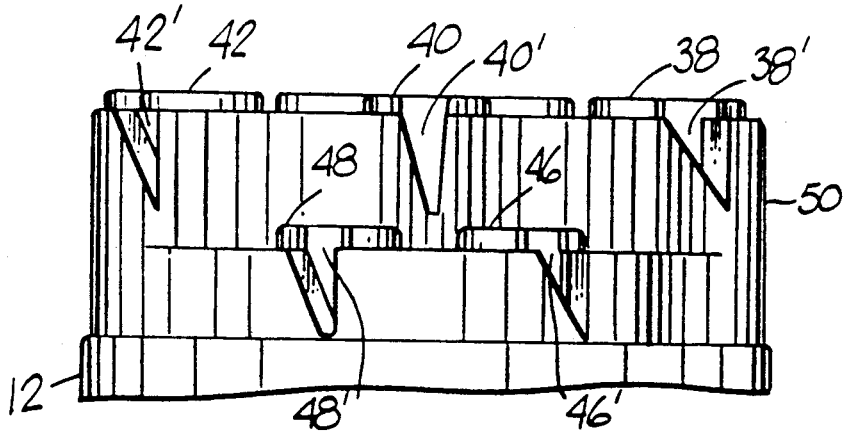
FIG. 5 is a side view of the top portion of the golf bag of FIG. 1 taken along the line 5—5 of FIG. 2.
Figure 6:
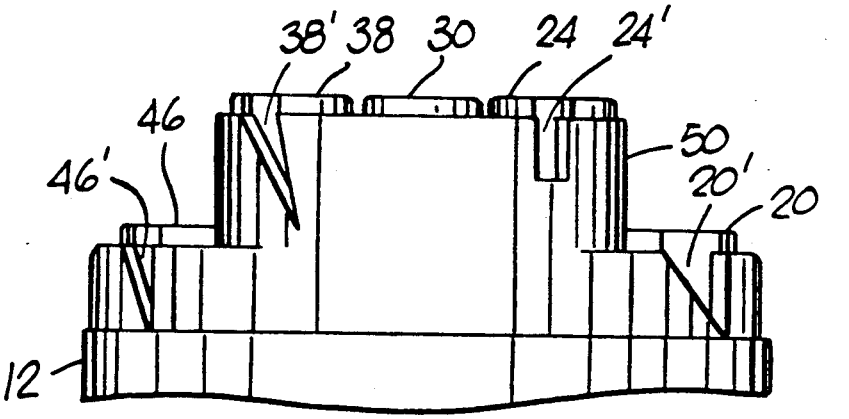
FIG. 6 is a side view of the top portion of the golf bag of FIG. 1 taken along the line 6—6 of FIG. 2.

Referring now to the pictorial diagram of FIG. 1, there is shown a golf bag 10 that includes a cylindrical body 12, constructed of any of a number of commercially available plastic or other materials, within which a plurality of parallel tubes identified with even-numbered reference numerals 20–42, 46, and 48 are fixedly vertically positioned to accommodate the individual clubs of a set of golf clubs that typically comprises four wood clubs, nine iron clubs, and a putter. The tubes identified with even-numbered reference numeral 20–42, 46, and 48 may be constructed of any of a number of commercially available plastic materials and are held in position at their top ends by a circular header 50 and at a point intermediate their length by a retainer plate 52 through which they pass. The material chosen for fabrication of the tubes identified with even-numbered reference numerals 20–42, 46, and 48 is preferably one which will prevent marring of graphite shafts of clubs. Alternatively, the top 3–6 inches of the tubes identified with even-numbered reference numerals 20–42, 46, and 48 may be lined with such a material. Header 50 may comprise a molded plastic component, for example, that includes an arrangement of fourteen holes, as illustrated more completely in the top view of FIG. 2, for receiving corresponding ones of the tubes identified with even-numbered reference numerals 20–42, 46, and 48. Header 50 includes two diametrically opposite lower surfaces at the same height on which the top ends of tubes 20, 22, 46, and 48 terminate and an upper surface on which the ten remaining ones of tubes 20–48 terminate. Tubes 20, 22, 24, 28, 30, 36, 38, 42, 46, and 48 are centered generally equidistantly along a circle that lies within the periphery of circular header 50. The remaining tubes 26, 32, 34, and 40 are positioned as shown within that circle. Tubes 30, 32, 34, and 40 are centered generally equidistantly on a diametric line on the upper surface of header 50. Tubes 30, 32, 34, and 36 are intended to retain the four wood clubs 60, 62, 64, and 66 of the complete set of clubs retained in golf bag 10. Each of tubes 30, 32, 34, and 36 is plugged at a different point along its length the tubes identified with even-numbered reference numerals 20–42, 46, and 48 such that when the four wood clubs 60, 62, 64, and 66 are inserted into their respective tubes 30, 32, 34, and 36, the heads of those wood clubs are at different heights above header 50 to prevent interference with each other and with the heads of the nine iron clubs and the putter that are retained in the other ones of identified with the even-numbered reference numerals 20–42, 46, and 48. While all of the fourteen tubes identified with the even-numbered reference numerals 20–42, 46, and 48 are illustrated as having the same diameter, it may be convenient to provide one or two of them, such as tubes 24, 38, in larger diameter than the others so that they can accommodate a ball retriever or an umbrella, in the event the user does not wish to carry a full complement of fourteen clubs.

Each of the tubes 20, 22, 24, 26, 28, 38, 40, 42, 46, and 48 is formed to include a corresponding downward-directed, generally V-shaped notch 20', 22', 24', 26', 28', 38', 40', 42', 46', and 48' that extends into an adjacent portion of header 50. Each of these ten V-shaped notches is formed to receive, in generally mating engagement, the head of a specific one of the nine iron clubs and the putter, and each of these ten V-shaped notches would be appropriately reversed from the illustrations of FIGS. 1–6 in the case of left-handed clubs. Each of the nine iron clubs and the putter is thereby suspended in its associated one of tubes 20, 22, 24, 26, 28, 38, 40, 42, 46, and 48 in a position in which the head of the club or putter is directed outwardly by virtue its engagement with its associated one of notches 20', 22', 24', 26', 28', 38', 40', 42', 46', and 48'. In these fixed, outwardly directed positions, the heads of the nine iron clubs and the putter are readily identifiable and accessible to the user and cannot interfere with each other or with the wood club heads 60, 62, 64, and 66 that are positioned above them. One arrangement of a full complement of clubs that has been found desirable is the following: tube 20 (sand wedge), tube 22 (#8 iron), tube 24 (putter), tube 26 (#6 iron), tube 28 (#4 iron), tube 30 (#5 wood), tube 32 (#7 wood), tube 34 (#3 wood), tube 36 (driver), tube 38 (pitching wedge), tube 40 (#5 iron), tube 42 (#3 iron), tube 46 (#9 iron), and tube 48 (#7 iron).

I claim:

1. A golf bag for retaining a set of golf clubs in upright fixed positions, comprising:

an outer housing;

a plurality of vertical tubes positioned within the outer housing, each one of said plurality of vertical tubes being dimensioned to receive an associated one of the set of clubs to be retained in the bag;

a two-level tube header positioned at the top end of the outer housing and including means for suspending said tubes;

the plurality of vertical tubes being suspended within the outer housing by the two-level tube header, a top end of each of the vertical tubes terminating at one of two levels of the tube header, each one of the top ends of a first group of said plurality of vertical tubes having an outwardly and downwardly extending notch therein dimensioned and formed to matingly engage a head of the associated one of the set of clubs to thereby position the heads of the clubs retained in said first group of said plurality of vertical tubes in a fixed outwardly directed position, each one of a second group of said plurality of vertical tubes having a plug therein to receive a shaft end of the associated one of the set of clubs, the plugs in the second group of said plurality of vertical tubes being at predetermined different positions such that the heads of the clubs retained in said second group of said plurality of vertical tubes are at staggered heights higher than heights at which the heads of the clubs retained in said first group of said plurality of vertical tubes are positioned; and separation means positioned within the outer housing and spaced downward from the two-level tube header to receive said plurality of vertical tubes and to maintain them in substantially parallel relationship to each other.

2. A golf bag as in claim 1 wherein:

a number of said plurality of vertical tubes are centered on a circle within an outer periphery of said tube header; and said second group of said plurality of vertical tubes are positioned on a diametric line of said tube header and terminate on a top level of said tube header.

3. A golf bag as in claim 1 wherein said outer housing is generally cylindrical and an outer periphery of said tube header is circular.

4. A golf bag as in claim 3 wherein said outer housing and said tube header are of substantially the same diameter.

* * * * *